United States Patent [19]

Brenner

[11] 4,407,191

[45] Oct. 4, 1983

[54] WEIGHT INDICATOR FOR REFUSE COMPACTOR

[75] Inventor: Robert A. Brenner, Berrien County, Mich.

[73] Assignee: Whirlpool Corporation, Benton Harbor, Mich.

[21] Appl. No.: 305,323

[22] Filed: Sep. 24, 1981

[51] Int. Cl.[3] ..... B30B 15/00

[52] U.S. Cl. ..... 100/99; 100/229 A; 177/46

[58] Field of Search ..... 100/99, 229 A; 177/46, 177/208; 141/83; 116/227

[56] References Cited

U.S. PATENT DOCUMENTS

| | | | |
|---|---|---|---|
| 370,171 | 9/1887 | Wickey | 100/99 |
| 2,080,321 | 5/1937 | Kunkel | 179/5 P |
| 2,412,270 | 12/1946 | Johnston | 68/13 |
| 2,604,035 | 7/1952 | Shipley et al. | 100/99 |
| 3,126,069 | 3/1964 | Shepley | 100/99 |
| 3,136,434 | 6/1964 | Mauderer | 177/208 |
| 3,418,966 | 12/1968 | Carlson | 116/227 |
| 3,472,328 | 10/1969 | Holman | 177/208 |
| 3,822,638 | 7/1974 | Merkin | 100/99 |
| 3,994,216 | 11/1976 | Difley | 100/229 A |
| 4,164,178 | 8/1979 | Baumann et al. | 100/99 |

FOREIGN PATENT DOCUMENTS

| | | | |
|---|---|---|---|
| 493815 | 4/1976 | Australia | 100/99 |

*Primary Examiner*—Billy J. Wilhite

*Attorney, Agent, or Firm*—Wood, Dalton, Phillips, Mason & Rowe

[57] ABSTRACT

A weight indicator for use with a refuse compactor. Structure is provided for sensing the weight of refuse in the refuse compactor receptacle. An indicator is operatively associated with the sensing structure to provide an indication of the sensed weight to the user of the refuse compactor. In the illustrated embodiment, the sensing structure is operated as an incident of moving the receptacle to an accessible position. The receptacle is disposed to be pivoted by the weight of refuse therein when disposed in the accessible position and the sensor structure is responsive to the pivotal displacement. In the illustrated embodiment, the sensing and indicating structure are fluid operated and define a movement amplifier for facilitating readout of the weight indication.

16 Claims, 4 Drawing Figures

FIG. 1
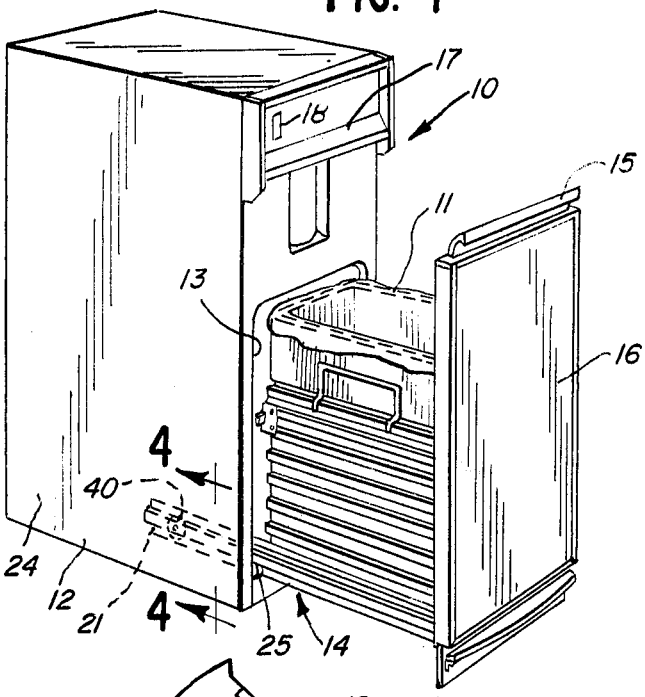
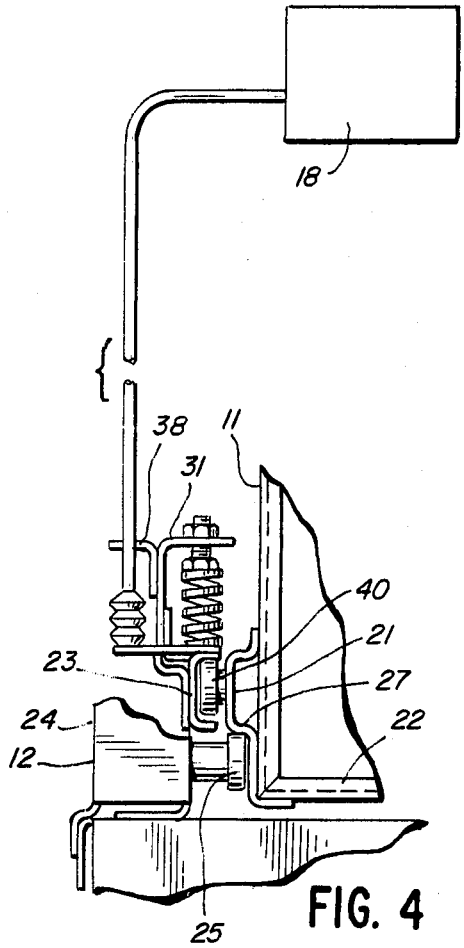
FIG. 4
FIG. 2
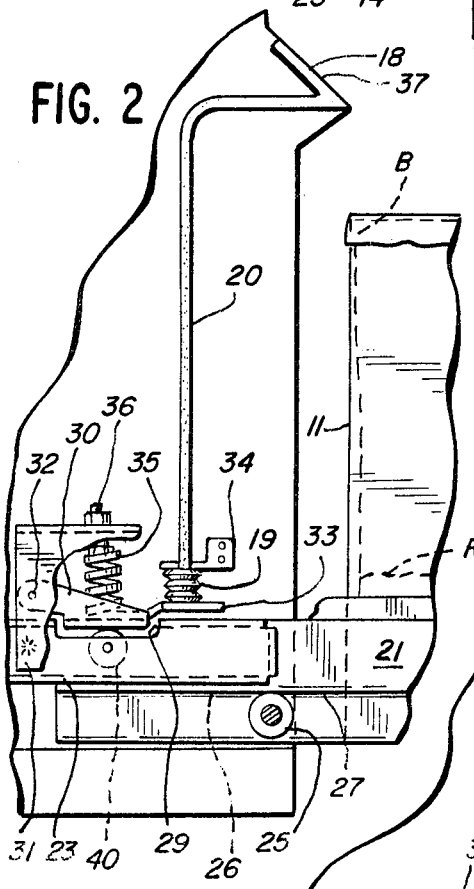
FIG. 3
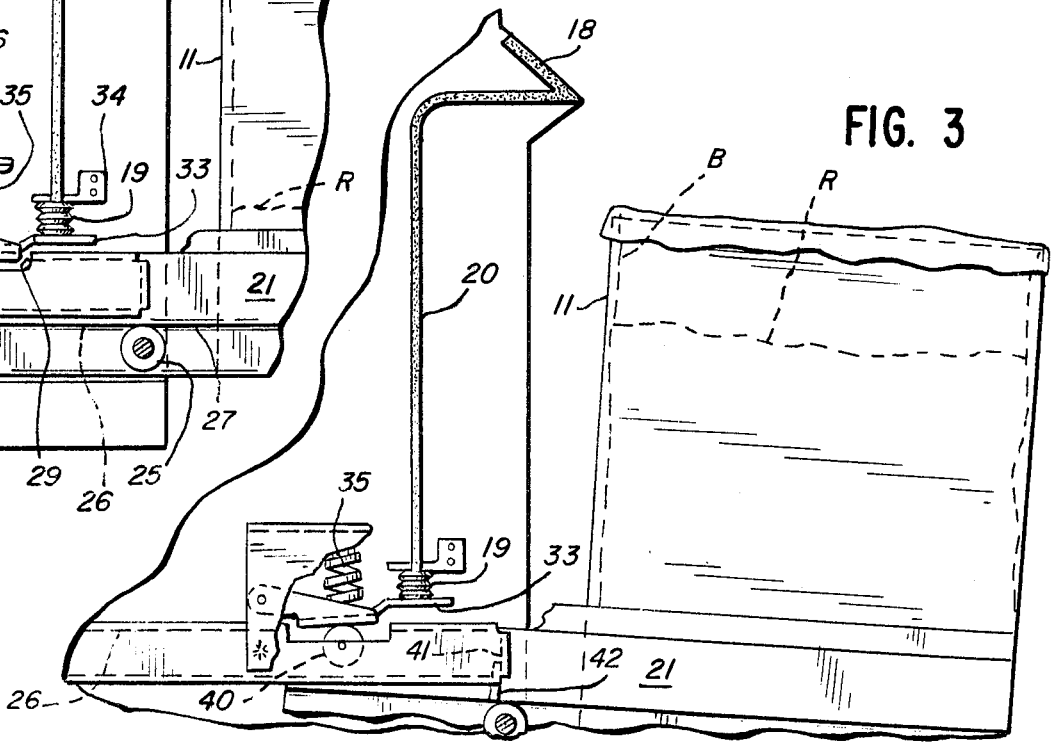

WEIGHT INDICATOR FOR REFUSE COMPACTOR

BACKGROUND OF THE INVENTION

1. Field of the Invention

This invention relates to refuse compactors and more specifically to means for indicating the weight of refuse in the compaction receptacle of the compactor.

2. Description of the Background Art

It has been conventional in the operation of refuse compactors to determine a full condition of the compactor receptacle as a function of the amount of travel of the compacting ram permitted by the refuse in the receptacle. Thus, when the amount of refuse reaches a maximum desired quantity, the restricted downward movement of the ram is sensed to provide an indication of the full condition. One such structure is illustrated in U.S. Pat. No. 3,822,638 of Eugene Merkin. As disclosed therein, an indicator is carried on a flexible cable secured to the compactor ram. The downward movement of the ram is sensed by the movement of the indicator.

Manfred Baumann et al., in U.S. Pat. No. 4,164,178, disclose a refuse compactor wherein a signaling device is mounted on the lid of the receptacle. The signal device includes a spring-loaded pressure sensor engaging the refuse within the compactor and an indicator visible outside the lid.

It has further been known to provide tilt switches in the refuse compactor which prevent further operation of the compactor in the event the receptacle is undesirably tilted during the compaction operation. One example of such a refuse compactor structure is disclosed in U.S. Pat. No. 3,994,216 of Charles Rogers Difley et al., which patent is owned by the assignee hereof.

SUMMARY OF THE INVENTION

The present invention comprehends an indicating means for use with a refuse compactor which provides an indication to the user when the weight of the refuse in the compaction receptacle reaches a preselected maximum weight. In the conventional domestic refuse compactor, the refuse is compacted within a suitable bag to facilitate the removal of the compacted refuse for disposal by deposition in a conventional garbage can or the like. It is desirable to limit the weight of the compacted refuse to a preselected weight to permit the removal and transfer thereof comfortably by the user and without tearing or other failure of the bag during the attempted removal and transfer. It has been found that it is desirable to limit the weight to a weight of approximately 25 to 35 lbs. for this reason. The present invention is directed to the provision of means for indicating to the user the weight of the refuse in the receptacle so as to permit facilitated use of the trash compactor free of such undesirable tearing or other failure of the compactor bag.

More specifically, the present invention comprehends the provision in a refuse compactor having a receptacle into which refuse is placed for compaction and subsequent disposal and means for mounting the receptacle for selective disposition in a recessed compaction position within the compactor and an accessible position exposed outwardly of the compactor, of an indicating means for indicating the weight of refuse disposed in the receptacle.

In the illustrated embodiment, the indicating means indicates the weight of the refuse disposed in the receptacle when the receptacle is disposed in the accessible position.

In the illustrated embodiment, the indicating means comprises means for indicating the weight as an incident of the receptacle being brought to the accessible position.

In the illustrated embodiment, the means for mounting the receptacle comprises means permitting pivotal displacement of the receptacle as a function of the weight of refuse therein.

In the illustrated embodiment the indicating means comprises a fluid level indicating means, and sensing means are provided comprising a compressible housing means, such as a bellows, for providing a fluid signal to the indicating means corresponding to the compression of the sensing means by movement of the receptacle. The mounting means comprises track and roller means for carrying the receptacle between the compaction and accessible positions, and the sensing means may include means responsive to pivotal movement of a portion of the track in response to the weight of the receptacle.

In the illustrated embodiment, the sensing means includes adjustable means so as to adjust the indication provided by the indicating means corresponding to the weight of the refuse in the receptacle.

The invention comprehends improved structure for movably mounting the receptacle to provide the desired operation of the sensing and indicating means.

BRIEF DESCRIPTION OF THE DRAWING

Other features and advantages of the invention will be apparent from the following description taken in connection with the accompanying drawings wherein:

FIG. 1 is a perspective view of a refuse compactor having indicating means embodying the invention;

FIG. 2 is a fragmentary vertical section illustrating the arrangement of the sensing and indicating means when less than the maximum weight of refuse is disposed in the receptacle;

FIG. 3 is a view similar to that of FIG. 2 but illustrating the arrangement of the sensing and indicating means when the maximum desired weight of the refuse in the receptacle is reached; and FIG. 4 is a fragmentary enlarged transverse vertical section taken substantially along the line 4—4 of FIG. 1.

DESCRIPTION OF THE PREFERRED EMBODIMENT

In the exemplary embodiment of the invention as disclosed in the drawing, a refuse compactor generally designated 10 comprises a domestic refuse compactor having a drawer-type receptacle 11 mounted to be selectively disposed in a compacting position within a cabinet 12 of the compactor and an outwardly exposed accessible position, as shown in FIG. 1. Thus, receptacle 11 is movable through a front opening 13 in the cabinet and is guided for movement between the compaction and accessible positions through opening 13 by means of track and roller structure generally designated 14. Facilitated movement of the receptacle between the compaction and accessible positions is provided by means of a handle 15 on a front wall portion 16 of the receptacle drawer. The compactor may be provided with a control console panel 17 disposed above handle 15 when the drawer is in the inner compaction position.

As indicated briefly above, the invention is concerned with providing an indication of the weight of the refuse R disposed in the receptacle so as to permit the user to limit the weight of the compacted refuse to a desirable maximum amount commensurate with the user's ability to lift and transfer the compacted refuse in the normal use of the refuse compactor. As further indicated above, the refuse is conventionally placed into a bag B arranged to effectively line the receptacle. Upon completion of the compaction of the maximum desired amount of refuse, the user merely gathers the top of the bag, lifts the bag from the receptacle, and disposes of the bagged compacted refuse as desired.

As shown in FIG. 1, the control console may include a visual indicator 18 providing an indication of the weight of the refuse in the bag in receptacle 11. In the illustrated embodiment, the indicator is fluid operated and illustratively comprises a sight tube of conventional construction. The indicator is connected to a compressible fluid container, such as bellows 19, by a suitable duct 20. Thus, the amount of compression of the bellows in indicated in the indicator as a result of the fluid transfer therebetween.

The invention comprehends the provision of any suitable means for providing an indication of the weight of the compacted refuse to provide an improved, facilitated controlled use of such a refuse compactor. Thus, as will be obvious to those skilled in the art, the fluid-operated sensing and indicating means is exemplary only.

In the illustrated embodiment, the track and roller structure 14 includes a track 21 on a lower edge portion 22 of the receptacle 11. As shown, a roller 40 is mounted to the rear portion of the track to roll in a fixed track 23 located within the cabinet 12 adjacent the inner surface of the sidewall 24.

A roller 25 is mounted within the cabinet 12 adjacent opening 13 and, as shown in FIG. 4, track 21 rides on roller 25. Thus, in normal functioning of the track and roller means 14, roller 40 rides along the underside of the top flange 26 of track 23 and roller 25 rides along the lower flange 27 of track 21.

However, as indicated in FIG. 2, in the present invention, a portion of the top flange 26 inwardly adjacent the front opening 13 is removed. Thus, as shown, the opening 29 in the upper flange permits the roller 40 to bear upwardly against a movable force transfer lever 30 pivotally mounted to a fixed bracket 31 by a pivot 32. Lever 30 includes a distal portion 33 acting against the bellows 19, which, as indicated in FIG. 4, is retained by means of a suitable mounting bracket 34. The lever 30 and the bellows 19 thus operate to sense and amplify the effect of the pivotal movement of track 21 about the roller 25.

Lever 30 is biased in a clockwise direction around pivot 32, as shown in FIG. 2, by a spring 35. The tension of spring 35 may be adjusted by a suitable threaded adjusting screw 36 to provide adjustment of the displacement of the lever end 33 relative to forces transmitted to the lever by the roller 40.

As best illustrated with reference to FIGS. 2 and 3, when the receptacle is free of trash and in the forward accessible position the track 21 will be disposed in a substantially horizontal position due to the force of spring 35 acting on the roller 40, tending to pivot the track in a counterclockwise direction (FIGS. 2 and 3) about the fulcrum defined by the cabinet roller 25. Thus, under this condition, the sight tube 18 indicates an empty condition of the receptacle.

However, as seen in FIG. 3, when the compacted refuse reaches a preselected desired maximum amount, the weight thereof is sufficient to pivot the receptacle and track in a clockwise direction about roller 25 against the action of spring 35 sufficiently to compress bellows 19 for transferring fluid through duct 20 to cause the sight tube 18 to indicate a full condition of the receptacle. As indicated in FIG. 2, the sight tube may be provided with suitable indicia 37 for indicating the weight of the refuse over the range between the empty and full conditions of the receptacle.

The tracks 21 and 23 are provided with a pair of stops, 41 and 42, respectively, which engage to prevent additional forward movement of the receptacle 14 when it has reached the fully accessible position shown in FIG. 3, thereby ensuring that the tracks 21 and 23 are properly aligned for operation of the sensing and indicating means.

As a relatively small amount of movement of the lever portion 33 will cause a relatively large movement of the level of liquid in the sight tube, only a small amount of pivoting of the receptacle provides a full range of indication of the compacted refuse weight. As indicated above, the provision of the adjusting means 36 permits adjustment of the indication corresponding to the weight of the refuse in the receptacle, as desired.

As will be obvious to those skilled in the art, the receptacle includes a second track and roller mounting means on the right side of the drawer, as seen in FIG. 1. However, in the illustrated embodiment, only the left mounting structure is provided with the sensing means and, thus, the opening 29 is omitted from the top flange of the cabinet track 23 on the right assembly.

In the illustrated embodiment, the drawer is pivoted in its cantilevered accessible position so as to provide automatically an indication of the weight of the refuse contained therein. Thus, the user of the compactor may readily determine that before adding further refuse, the previously compacted refuse should be removed as having the desired preselected maximum weight. As the indication of the weight of the refuse is provided automatically when the drawer is moved to the accessible position, indication of the weight of the compacted refuse is available to the user at all times during introduction of further refuse into the receptacle.

As further illustrated in FIG. 4, bracket 31 may include an outturned portion 38 which may bear against a portion of the compactor frame so as to prevent torsional movement of the track 23 when the receptacle is in the accessible position.

The foregoing disclosure of specific embodiments is illustrative of the broad inventive concepts comprehended by the invention.

Having described the invention, the embodiments of the invention in which an exclusive property or privilege is claimed are defined as follows:

1. In a refuse compactor having a receptacle into which refuse is placed for compaction and subsequent disposal, and means for mounting the receptacle for selective reciprocative rectilinear movement for selective disposition of the receptacle in a recessed compaction position and an accessible position, the improvement comprising indicating means indicating the weight of the refuse previously placed in the receptacle upon movement of the receptacle from the compacting position to the accessible position to provide an indication of the additional amount of refuse which may be further placed in the receptacle in said accessible position before reaching a desired maximum weight.

2. The refuse compactor structure of claim 1 wherein said indicating means comprises means for indicating the weight of refuse disposed in the receptacle as an incident of the receptacle being disposed in said accessible position.

3. The refuse compactor structure of claim 1 wherein said means for mounting the receptacle comprises means permitting pivotal displacement of the receptacle as a function of the weight of the refuse in the receptacle in said accessible position and said indicating means is responsive to the amount of said pivotal displacement.

4. The refuse compactor structure of claim 1 wherein said indicating means comprises a sight tube in which a fluid level varies in response to the weight of the refuse disposed in said receptacle.

5. The refuse compactor structure of claim 1 further including adjustable means for adjusting the indication produced by the weight in said receptacle.

6. The refuse compactor structure of claim 1 wherein said mounting means comprises track and roller means and said indicating means is responsive to pivotal movement of the track relative to the roller means when said receptacle is in said accessible position.

7. In a refuse compacting apparatus having a receptacle for compacted refuse, means for mounting said receptacle for selective reciprocative rectilinear horizontal movement, including cantilever track means for supporting said receptacle in a predetermined outward position, and stop means associated with said track means for stopping outward horizontal movement of said receptacle at said predetermined outward position, said track means permitting pivotal movement of said receptacle mounting means when said receptacle is in said outward position, a weight sensing and indicating means for indicating the weight of the refuse previously placed in the receptacle comprising:

movement sensing means disposed adjacent said track means for sensing the pivotal movement of said mounting means at said outward position; and indicating means operatively associated with said movement sensing means providing an indication of the amount of pivotal movement of said mounting means and an indication of the additional amount of refuse which may be further placed in the receptacle before reaching a desired maximum weight.

8. The refuse compacting apparatus of claim 7 wherein said movement sensing means comprises a lever displaceable in response to said pivotal movement.

9. The refuse compacting apparatus of claim 7 wherein said movement sensing means comprises a compressible fluid reservoir.

10. The refuse compacting apparatus of claim 7 wherein said support means comprises track and roller means.

11. In a refuse compacting apparatus having a horizontally movable receptacle for compacted refuse, means for sensing the weight of the compacted refuse in said receptacle, comprising:

a first track member fixed within said compacting apparatus and defining a horizontally extending flange along its length;

means defining an opening in a forward portion of said track flange;

fulcrum means located forwardly of said first track member;

a second track member movable with said refuse receptacle and arranged for sliding movement along said first track member; and movement sensing means disposed adjacent said second track member, horizontal movement of said receptacle and second track member to a position at which the rear portion of said second track underlies said flange opening causing pivotal movement of said second track about said fulcrum means to actuate said movement sensing means.

12. The refuse compacting apparatus of claim 11 wherein said movement sensing means is disposed adjacent said track flange opening and defines a movable track flange portion.

13. The refuse compacting apparatus of claim 12 further including indicating means operatively associated with said movement sensing means for providing a visual indication of the amount of said pivotal movement.

14. The refuse compactor structure of claim 13 wherein said indicating means comprises fluid-operated means and said sensing means comprises a compressible housing having fluid therein and fluid duct means extending between said housing means and said indicating means.

15. The refuse compactor structure of claim 13 wherein said indicating means comprises a sight tube and said sensing means comprises a fluid-filled bellows, and fluid duct means extending between said bellows and said sight tube.

16. The refuse compactor structure of claim 11 wherein said sensing means comprises motion amplifying means.

* * * * *